United States Patent [19]

Meyer et al.

[11] Patent Number: 4,549,498

[45] Date of Patent: Oct. 29, 1985

[54] SPEED CONTROLLING APPARATUS

[75] Inventors: Dennis F. Meyer; James E. Schuster, both of Bismarck, N. Dak.

[73] Assignee: I.M.S., Inc., Bismarck, N. Dak.

[21] Appl. No.: 410,831

[22] Filed: Aug. 23, 1982

Related U.S. Application Data

[63] Continuation-in-part of Ser. No. 374,173, May 3, 1982, abandoned.

[51] Int. Cl.[4] ..... B63H 25/44

[52] U.S. Cl. ..... 114/145 A

[58] Field of Search ..... 114/145 R, 145 A; 440/66

[56] References Cited

U.S. PATENT DOCUMENTS

| | | | |
|---|---|---|---|
| 1,576,237 | 3/1926 | Dawson | 114/145 A |
| 1,799,455 | 4/1931 | Cavert . | |
| 2,050,336 | 8/1936 | Karasinski | 115/17 |
| 2,230,958 | 2/1941 | Langdon | 114/145 |
| 2,288,505 | 6/1942 | Weber | 115/17 |
| 2,654,336 | 10/1953 | Katzung | 115/0.5 |
| 2,719,503 | 10/1955 | Smith | 115/18 |
| 2,751,875 | 6/1956 | Henry | 115/18 |
| 2,787,974 | 4/1957 | Johnson | 115/18 |
| 2,914,019 | 11/1959 | Gewin | 114/145 A |
| 2,998,795 | 9/1961 | Downie | 114/145 A |
| 3,117,548 | 1/1964 | Rasmussen | 115/17 |
| 3,136,280 | 6/1964 | Bergum | 115/17 |
| 3,209,716 | 10/1965 | Hartley | 114/145 |
| 3,384,045 | 5/1968 | Lusby | 114/145 A |
| 3,603,277 | 9/1971 | Manary | 114/145 A |
| 3,965,838 | 6/1976 | Uht | 114/145 A |
| 4,026,231 | 5/1977 | Fedorko | 114/145 A |
| 4,352,666 | 10/1982 | McGowan | 440/66 |

*Primary Examiner*—Trygve M. Blix
*Assistant Examiner*—Stephen P. Avila
*Attorney, Agent, or Firm*—Kinney & Lange

[57] ABSTRACT

Speed controlling apparatus particularly is disclosed to be mounted with respect to a boat motor in a position confronting the propeller wash of the boat's motor, whereby the thrust imparted to the water by the motor's propeller is significantly deflected or attenuated, thus reducing boat speed. The contemplated speed controlling apparatus includes a mounting plate adapted to be mounted upon the motor housing, and a deflection or trolling plate coupled to said mounting plate to be disposable between a first position confronting the propeller wash, and a second position disposed remotely from the path of the propeller wash. In a first aspect of this invention, the deflection plate is variably disposed with respect to the path of the propeller wash and in particular, may be disposed at variable depths within the water. The deflection plate includes at least one vane extending therefrom having a portion that extends below the bottom most edge of the deflection plate to be directly disposed within the propeller's wash to impart the desired controlling action upon the boat's movement.

23 Claims, 8 Drawing Figures

FIG. 1.
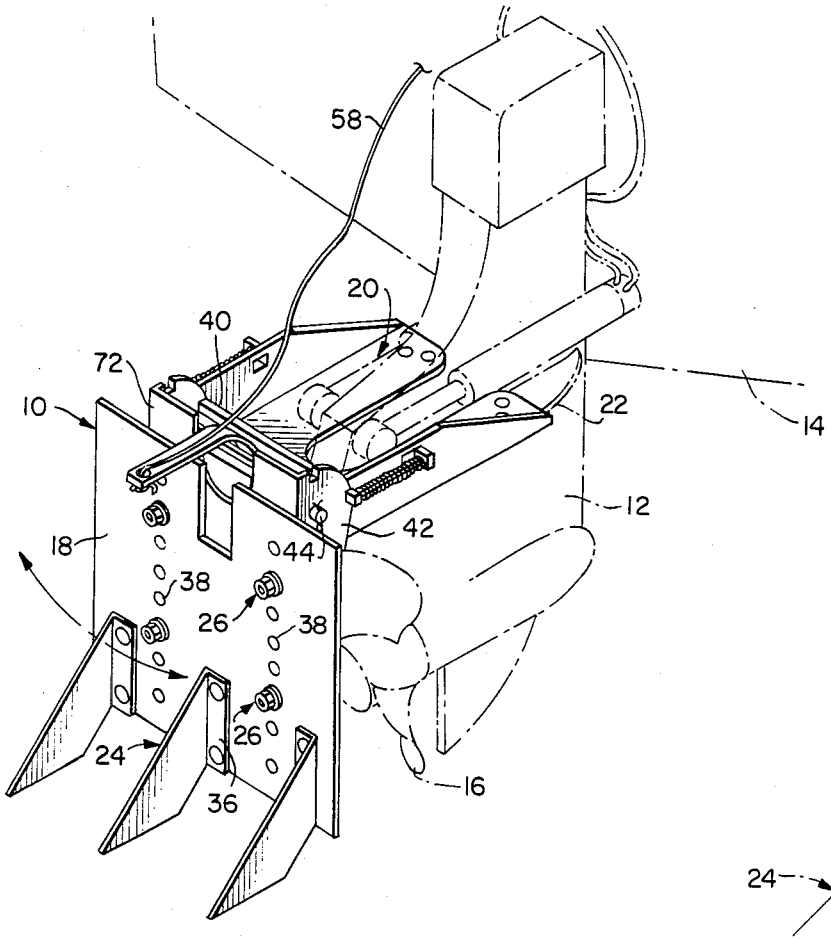
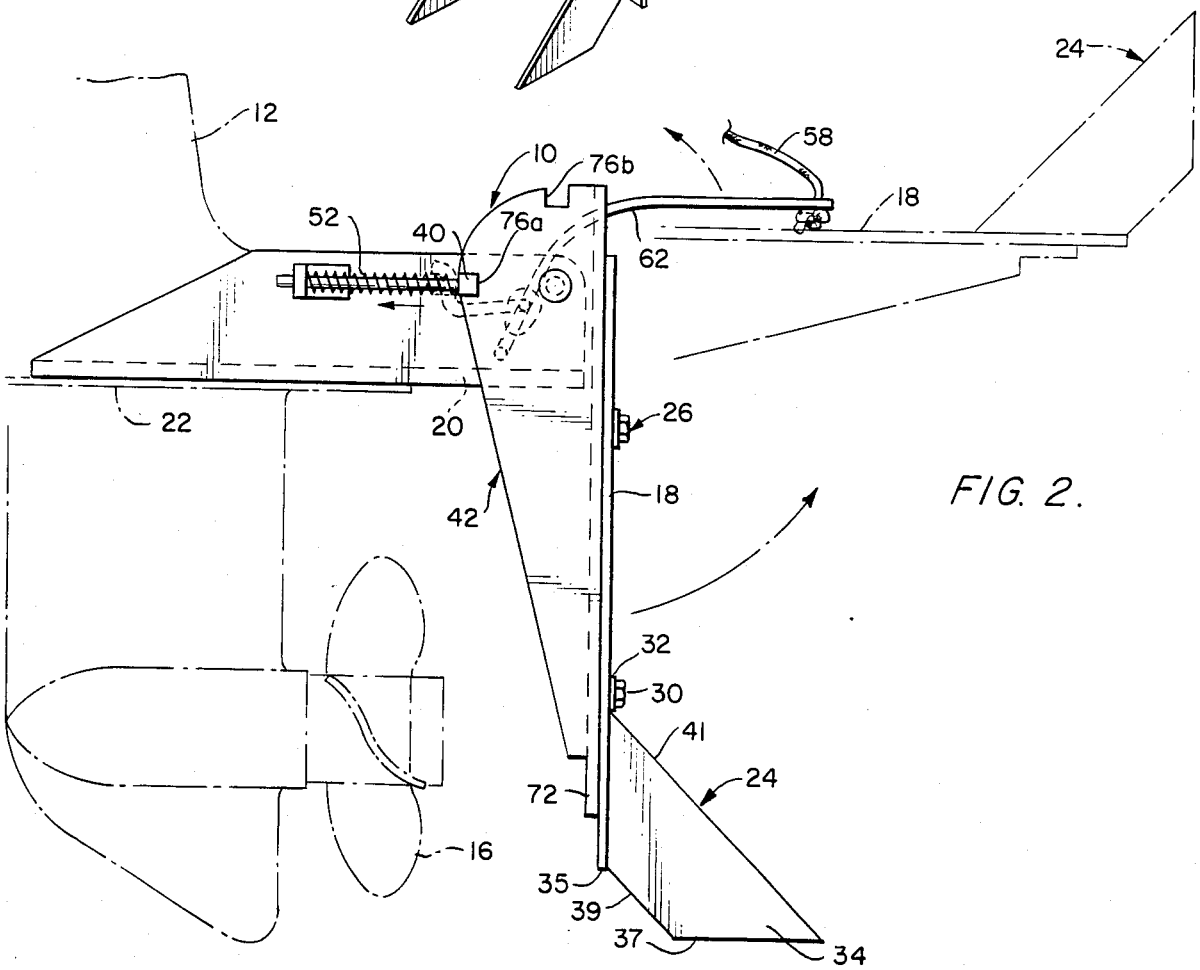
FIG. 2.

SPEED CONTROLLING APPARATUS

This application is a continuation-in-part of application Ser. No. 374,173 filed May 3, 1982, now abandoned.

BACKGROUND OF THE INVENTION

Description of the Prior Art

This invention, in its preferred form, relates to speed controlling apparatus, and particularly to such apparatus as adapted to be mounted with respect to a motor boat, whereby the motor boat may be operated at very low rates of speed.

The prior art has recognized the desirability of operating motor boats at relatively slow speeds to facilitate trolling, whereby a fishing line is drawn slowly through the water to attract desired species of fish. Most motors used to propel fishing or recreational boats are gas-type motors that are designed to operate at a single rate of speed. Such gasoline motors are not typically associated with speed changing mechanisms such as would be provided by a set of gears. Rather, speed control is obtained by manipulating the fuel throttle of the boat's motor.

A problem arises when it is desired to operate such motors at a very slow speed, even slower than the minimum or idle speed of the boat's motor. To this end, the prior art as illustrated by U.S. Pat. Nos. 1,576,237 of Dawson; 1,799,455 of Cavert; 2,719,503 of Smith; 2,998,795 of Downie et al.; and 4,026,231 Fedorko, has disclosed speed changing apparatus taking the form of a plate typically known as a trolling plate that is disposed in a position immediately behind the motor's propeller and transverse to its wash. The disposition of a trolling plate to confront the propeller's wash significantly reduces the effectiveness of the motor to propel the boat, whereby the motor may operate at speeds in access of its idling speed and yet move the boat at the desired relatively low or trolling speeds.

The above referenced Dawson patent discloses an attachment for boats that mounts a trolling plate in a variety of positions between a fully vertical position and a fully horizontal position. A plurality of apertures are disposed to receive an adjustable screw, whereby the position of the trolling plate may be locked in each of a plurality of positions corresponding to the apertures.

The above referenced Fedorko patent discloses a hydraulic mechanism, whereby its trolling plate may be disposed from a fully vertical position through a series of infinite intermediate positions to a fully horizontal position. The hydraulic mechanism includes a motor, whereby a piston is rectilinearly driven to thereby reposition the trolling plate as desired. Suitable valve mechanisms are provided, such that when the hydraulic pump is deactuated, the fluid directed to the hydraulic mechanism is trapped, whereby the trolling plate is locked in position.

The prior art has recognized several problems as yet unsolved, related to the use of such trolling plates. First, trolling plates of the prior art are particularly adapted to be used with a particular boat and/or outboard motor and are not readily adapted to be used with a variety of boats, motors and/or propellers of varying size, thus preventing the transfer of such a trolling plate and its mounting mechanism from one motor or boat to the next. Further, it is contemplated that an outboard motor may be used with propellers of varying size, thus requiring an adjustment of the size and/or position of the trolling plate, such adjustment not now being provided by the teachings of the prior art.

A further unsolved problem of the prior art relates to the difficulty in controlling a boat when subject to even modest wind conditions, and in particular when the wind is directed across the sides of the boat. Under such conditions, the boat is blown side ways, such loss of control being particularly aggravated when the boat is being propelled at very slow speeds, i.e. when used with a trolling plate. A related problem appears when it is desired to steer the boat at very slow speeds as would be contemplated with the use of these trolling plates.

SUMMARY OF THE INVENTION

It is therefore an object of this invention to provide a new and improved speed controlling apparatus particularly adapted to be used with a boat and its motor, whereby increased stability and boat control is achieved when the boat is operated at low, trolling speeds.

It is a further object of this invention to provide a new and improved speed controlling apparatus in the form of a deflection or trolling plate adapted to be variably disposed with respect to the boat's motor, whereby such a plate is readily adaptable to be used with variable combinations of boats, motors or propeller sizes.

In accordance with these and other objects of the invention, there is disclosed a speed controlling apparatus particularly adapted to be mounted with respect to a boat motor in a position confronting the propeller wash of the boat's motor, whereby the thrust imparted to the water by the motor's propeller is significantly deflected or attenuated, thus reducing boat speed. The contemplated speed controlling apparatus includes a mounting plate adapted to be mounted upon the motor housing, and a deflection of trolling plate coupled to said mounting plate to be disposable between a first position confronting the propeller wash, and a second position disposed remotely from the path of the propeller wash. In a first aspect of this invention, the deflection plate is variably disposed with respect to the path of the propeller wash and in particular, may be disposed at variable depths within the water.

In a more particular aspect of this invention, a rotatable motor is rotatably coupled to the mounting plate to be disposed between the first and second positions and provides a surface for mounting the deflection plate, it being understood that the means for connecting the deflection plate and the rotatable member permit relative adjustment of the deflection plate with respect to the rotatable member. In a particular illustrative embodiment of this invention, the deflection plate is provided with a plurality of sets of openings for receiving fasting means illustratively in the form of a nut and bolt, whereby the deflection plate may be disposed in a plurality of corresponding positions with respect to the rotatable member.

In a further, significant feature of this invention, the deflection plate includes at least one vane extending therefrom and in an illustrative embodiment of this invention, a plurality of vanes extending along the path of the propeller wash to provide increased stability of the boat when it is propelled at slow, trolling speeds. In a particular illustrative embodiment of this invention, the vane or vanes have portion(s) that extend below the bottom most edge of the deflection plate to be directly disposed within the propeller's wash to impart the desired controlling action upon the boat's movement. The mounting plate is adapted to mount the deflection plate such that its lower most edge partially confronts the propeller wash and the lower portion of the vane is disposed within said propeller wash to impart the desired controlling action upon the boat's movement.

In a further feature of this invention, there is provided a simple, relatively inexpensive to manufacture detent mechanism disposable to a first locking position for maintaining the rotatable member in its first position whereby the deflection plate is disposed in a confronting relationship with the propeller's wash, and to a second released position, whereby the rotatable member and the deflection plate are permitted to rotate due to the force exerted by the boat's wash towards a second position, wherein the deflection plate 18 is removed from the propeller's wash. In particular, the detent mechanism includes a locking plate that presents a locking surface for abutting a mating surface of the rotatable member, whereby the rotatable member is locked in its first position. The locking plate is supported upon a flange of the mounting plate by a stud that extends losely through an opening of the flange and an opening within the locking plate to receive a spring that resiliently disposes the locking plate towards the flange to its first locking position. Further, there is included a fastening member affixed to the flange for presenting a surface against which the locking plate is stabilized and about which the locking plate is rotated to a second released position, whereby the deflection plate may in turn be rotated to its second position.

BRIEF DESCRIPTION OF THE DRAWINGS

A detailed description of a preferred embodiment of this invention is hereafter made with specific reference being made to the drawings in which:

FIG. 1 is a perspective view of the speed controlling apparatus of this invention as coupled to an outboard motor adapted for use with a boat;

FIG. 2 is a side view of the speed controlling apparatus as shown in FIG. 1;

DESCRIPTION OF THE PREFERRED EMBODIMENT

Figure 3:
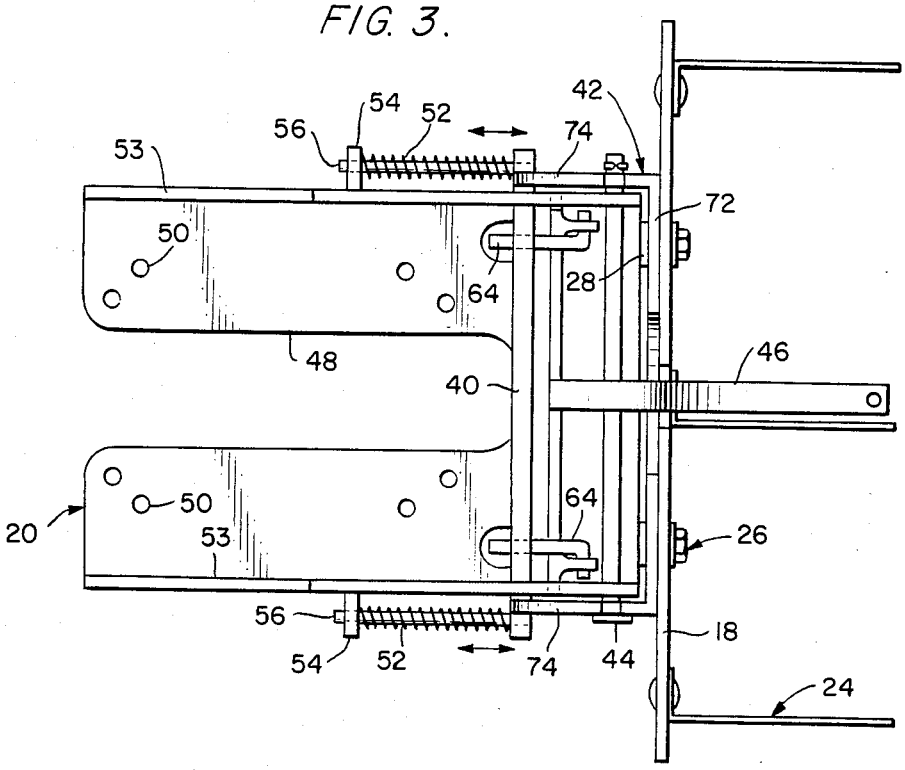
FIG. 3 is a top, plan view of the speed controlling apparatus as shown in FIGS. 1 and 2.

Referring now to the drawings and in particularly to FIG. 1, there is shown a speed controlling apparatus in accordance with teachings of this invention, as comprising a mounting plate 20 adapted to be mounted upon a motor housing 12 and in particular, upon a cavitation plate 22 of the motor housing 12, as particularly shown in FIG. 2. In a manner well known in the art, the motor housing 12 is suspended from a stern 14 of a boat, as shown in FIG. 1, and includes a rotatively driven propeller 16 for moving the boat through the water by forming, in a manner well known in the art, a flow of water directed along a path in a rearward direction of the boats stern 14. The water flow is designated herein as the "propeller wash". As shown in FIG. 2, a deflection plate 18 is rotatably suspended from the mounting plate 20 to be disposed from a first position, as shown in full line in FIG. 2, confronting to the wash of the boat's propeller 16, and a second position, as shown in dotted line in FIG. 2, removed from the path of the propeller wash and disposed substantially parallel to the water's surface.

As shown in FIGS. 1 and 2, the deflection plate 18 is mounted adjustably upon a rotatable member 42 by suitable fastening means taking the form of a plurality of fasteners 26, each illustratively taking the form of a bolt 28, a nut 30 and a washer 32 as disposed in a selected one set of a plurality of sets of openings 38 within the deflection plate 18, and a sole set of openings within the rotatable member 42. As shown in FIG. 3, the rotatable member 42 includes an attaching plate 72 having a set of openings therein for receiving the fasteners 26. By disposing but a single set of openings within the fastening plate 72 and a plurality of sets of openings 38 within the deflection plate 18, the deflection plate 18 may be disposed in a plurality of positions with respect to the mounting plate 20 and in particular with respect to the path of the propeller wash.

It is readily contemplated, that the deflection plate 18 may come in a variety of sizes and that deflection plates 18 of different sizes may be readily mounted upon the rotatable member 42 dependent selectively upon boat size, motor size and propeller size. For example, propellers 16 of different size may be used with the same motor dependent upon the desired boat use. In particular, if greater propulsion power is required, a propeller 16 of smaller propeller diameter will be selected. On the other hand, if the boat is to be driven at relatively high speeds and/or for longer distances, it is normally desired to use a propeller 16 of larger diameter. The deflection plate 18 of this invention is available in a variety of sizes to accommodate different sizes of the propeller 16. In particular, if the width dimension, i.e. the horizontal dimension of the deflection plate 18 as seen in FIG. 1, is selected to be less than the propeller diameter, the effectiveness of the deflection plate 18 to confront the propeller wash and to slow the boat speed, will be diminished significantly. Thus, it is desired to select a deflection plate 18 having a width dimension equal to or greater than the propeller diameter, whereby the effectiveness of the deflection plate 18 to attenuate boat speed is ensured. Once this minimal dimension is met, the mounting of a deflection plate 18 of even greater width does not significantly effect boat speed. As will be explained later, the position of the deflection plate 18 with respect to the propeller 16 may be varied and in particular the vertical position of the deflection plate 18, as seen in FIG. 2, may be adjusted up or down dependent upon weather conditions and the desired boat speed.

The mechanism for securing the speed controlling apparatus to the motor housing 12 is more fully shown in FIG. 3, wherein the mounting plate 20 is shown as including a U-shaped recess 48 for receiving therein the motor housing 12. Further, the mounting plate 20 includes a plurality of openings 50 for receiving suitable fasteners, e.g. nuts and bolts, that would be disposed therethrough and a like set of openings (not shown) within the cavitation plate 22, whereby the mounting plate 20 and thus the speed controlling apparatus 10 is secruely fastened to the motor housing 12. The mounting plate 20 includes on either side a flange 53. A pin 44 is disposed through openings within each of the flanges 74 to rotatively couple the deflection plate 18 with respect to the mounting plate 20.

Figure 4:
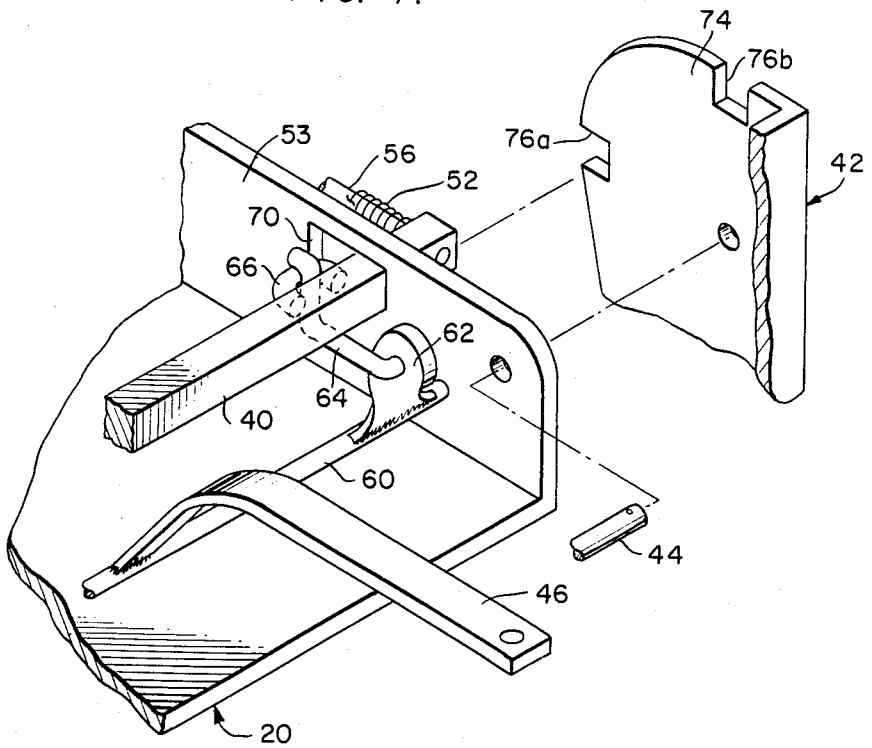
FIG. 4 is a partial, perspective view of a locking mechanism, whereby the position of the deflection plate may be locked with respect to the mounting plate.

The mechanism for locking the position the deflection plate 18 with respect to the mounting plate 20, is shown in FIGS. 3 and 4. In particular, the rotatable member 42 includes a flange 74 disposed on either side of the attaching plate 72; each flange 74 has, for example, a pair of detent slots 76*a* and 76*b*, for receiving a detent member 40 to thereby lock the position of the rotatable member 42 and its deflection plate 18 with respect to the mounting plate 20. The detent member 40 extends through slots 70 within the flanges 53 and is spring biased by a pair of biasing springs 52 disposed at either end thereof, as shown in FIG. 3. A like pair of guide rods 56 are respectively associated with the springs 52 and in particular, are disposed therethrough for controlling the biasing action of the springs 52 on the detent member 40. One of each of the guide rods 56 slides in bracket 54, as detent member 40 moves in the slot 70. The other end of the guide rod 56 is fixedly secured to the detent member 40, whereby it is urged by the springs 52 into an engaging position with one of the detent slots 76*a* or 76*b*. As shown in FIG. 2, when the detent member 40 is engaged with the detent slot 76*a*, the deflection plate 18 is locked in its first position, whereas when the detent member 40 is engaged with the detent slot 76*b*, the deflection plate 18 is locked in its second position.

The mechanism for releasing the detent member 40 from one of its detent slots 76*a* or 76*b*, is shown in FIG. 4. Openings in each of the flanges 74 are provided for receiving an end of a pivoting rod 60. A release lever 46 is fixedly secured, as by welding, to the pivoting rod 60, whereby the pivoting rod 60 may be rotated in a counter clockwise direction, as shown in FIG. 2, to dispose the detent member 40 to the right as shown by the arrow in FIG. 2, against the biasing action of the springs 52. To this end, a cord 58 is attached to the other end of the interconnecting lever 62 to permit the boat operator to pull the cord, thereby rotating the interconnection lever 62 to release the detent member 40. Though not shown in the drawings, it is contemplated that a series of pulleys is provided for suspending the cord 58 so that it may extent from the stern 14 of the boat to the operator, who may be stationed remotely at the bow of the boat. As shown in FIG. 4, the detent mechanism, further includes an interconnecting lever 62 fixedly secured, as by welding, to the pivoting rod 60, and a finger 62 having one end rotatively coupled to the interconnecting lever 62 and a second end coupled to the detent member 40 by a u-shaped catch 66. As shown in FIG. 3, it is understood that an interconnecting lever 62 and finger 64 are disposed at either end of the pivoting rod 60, to thereby impart a substantially uniform movement to the detent member 40 so that it is disposed to the left as seen in FIG. 3 to a second position that is substantially parallel to its initial, locking position as shown in FIG. 3.

As shown in FIG. 1, a plurality of vanes 24 is mounted on the deflection plate 18 to extend along the path of the propeller wash. Each vane 24 is welded to that side of the deflection plate 18 remote from the stern 14. Each vane 24 has an extended portion 34 projecting beneath a lower most edge 35 of the deflection plate 18 and into the wash or jet produced by the propeller 16, to effect control of the boat even under inclement, windy conditions. In this manner, the plurality of vanes and in particular their extended portions 34 are effective to direct and form the jet produced by the boats propeller 16 along a path coinciding with the boat axis, whereby side-ward wind will have less tendency to blow the boat off course even when moving at relatively slow or trolling speeds or when the boat is turning.

It is desired to control the vertical position of the deflection plate 18 as shown in FIG. 2 to maximize the effectiveness of the vanes 24 to add stability and control to the boat's movement. As shown in FIG. 2, the bottom most portion of the arc through which a blade of the propeller 16 moves, is aligned critically with respect to the lower most edge 35 in a manner to permit the vanes 24 to form the propeller wash into jets, thus enhancing boat stability and control. In one illustrative embodiment of this invention, each of the vanes 24 is dimensioned so that its extended portion 34 has a lower most edge 37 that is approximately two inches lower than the lower most edge 35 of the deflection plate 18. In such an embodiment, the deflection plate 18 is mounted by the fasteners 26 to the rotatable member 42, so that the tip of the propeller 16 is approximately one-half inch lower than the bottom most edge 35, as seen in FIG. 2, and one and a half inches higher than the lower most edge 37 of the vanes 24. It was found that such a configuration and dimensioning of the vanes 24 with respect to the propeller 16 enhance the effectiveness of the vanes 24 to form the propeller wash into jets. It was found that if the propeller 16 was positioned higher with respect to the deflection plate 18 so that the tip of the propeller 16 was above the lower most edge 35 as seen in FIG. 2, the effectiveness of the vanes 24 and in particular, of their lower portions 34 to form the propeller wash into jets, was substantially lost. On the other hand, if the deflection plate 18 is raised such that the lower most tip of the propeller 16 is significantly below the lower most edge 35 of the deflection plate 18, the deflection plate 18 loses its effectiveness to confront the propeller wash and to attenuate boat speed.

In an illustrative embodiment of this invention as shown in FIG. 1, the deflection plate 18 is provided with a plurality of vanes 24, e.g. 3, whereby two jets of propeller wash are formed to enhance boat stability and control. The use of more than one vane 24 is preferred in that the area of the guiding surface presented by the vanes 24 is thereby increased. As shown in FIG. 2, it is preferred to provide each vane 24 with a slanted, leading edge 39 and a slanted, trailing edge 41 to not only improve the aesthetic quality of the vanes 24, but also to minimize the debris that would otherwise be collected by the vanes 24.

The position of the deflection plate 18 with respect to the propeller 16 may be varied dependent upon weather conditions. For example, in inclement or windy weather, it may be desired to withdraw the deflection plate 18 partially from the water to thereby increase the speed of and/or the amount of water directed past the vanes 24 to thereby increase boat speed and control.

Figure 6:
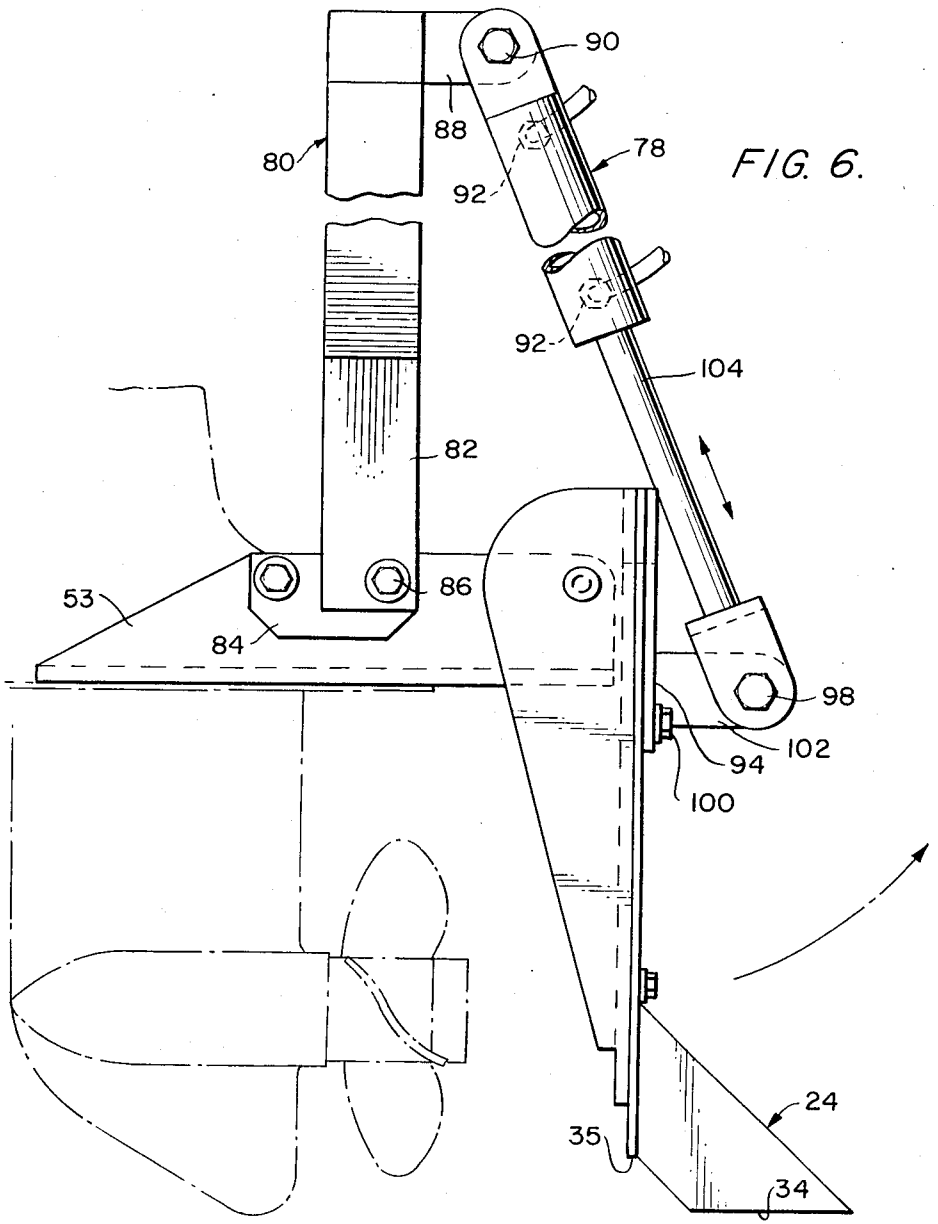
FIG. 6 is a side view of the further embodiment of the speed controlling apparatus as shown in FIG. 5.
Figure 5:
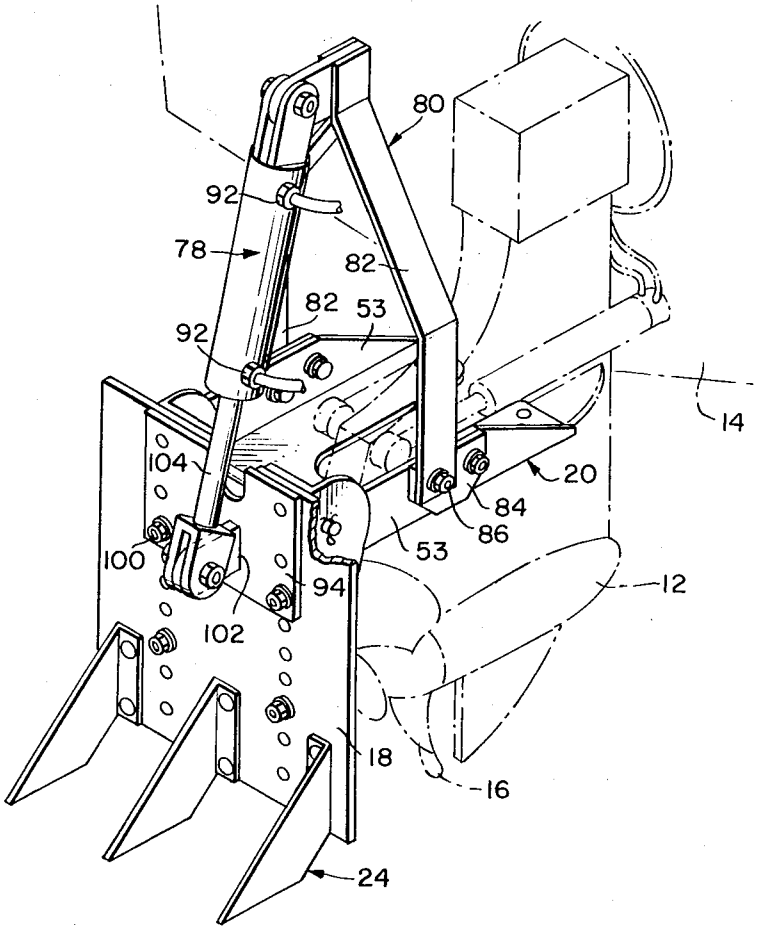
FIG. 5 is a perspective view of a further embodiment of this invention, wherein a hydraulic assembly is mounted upon the mounting member for positioning the deflection plate in any of a variety of positions with respect to the path of the propeller wash.

An alternative embodiment of this invention is shown in FIGS. 5 and 6 as including a hydraulic assembly 78 for disposing the deflection plate 18 from a first position disposed vertically, as shown in these figures, through an infinite variety of positions to a second, horizontal position, removed from the path of the wash produced by the boat's propeller 16. The hydraulic assembly 78 includes a drive rod 104 having one end disposed within the hydraulic assembly 78 with a piston attached thereto and adapted to be driven rectilineraly, as shown by the arrow in FIG. 6, as by pumping fluid through one or the other of the ports 92, as is well known in the art. The other end of the drive rod 104 is secured to the deflection plate 18 and in particular to a pivoting member 102, which in turn is affixed by an attaching member 94 to the deflection plate 18. The attaching member 94 is in turn secured to the deflection plate 18 by a plurality of suitable fasteners 100 such as nuts and bolts. The other end of the hydraulic assembly 78 is secured to a Y shaped, up-right support structure 80 that is suspended upon the mounting plate 20. Significantly, the structure 80 permits the speed controlling apparatus 10 of this invention to be used with any of a variety of boat motors, that would otherwise be prohibited if the hydraulic assembly 78 was directly secured to the motor housing 12. More specifically, as shown in FIG. 6, the support structure 80 has a pivoting member 88 secured to its top most portion, whereby one end of the hydraulic assembly 78 is rotatively secured thereto by a bolt 90. The other end of the hydraulic assembly 78 and in particular, the drive rod 104 is secured by a pin 98 to the pivoting member 102. The support structure 80 includes as shown in FIG. 5, a pair of legs 82 that are fastened respectively to the flanges 53 of the mounting plate 20, as by suitable fasteners 86 that are secured through openings within the flanges 53 and an attaching member 84 that is secured to the flanges 53.

Figure 7:
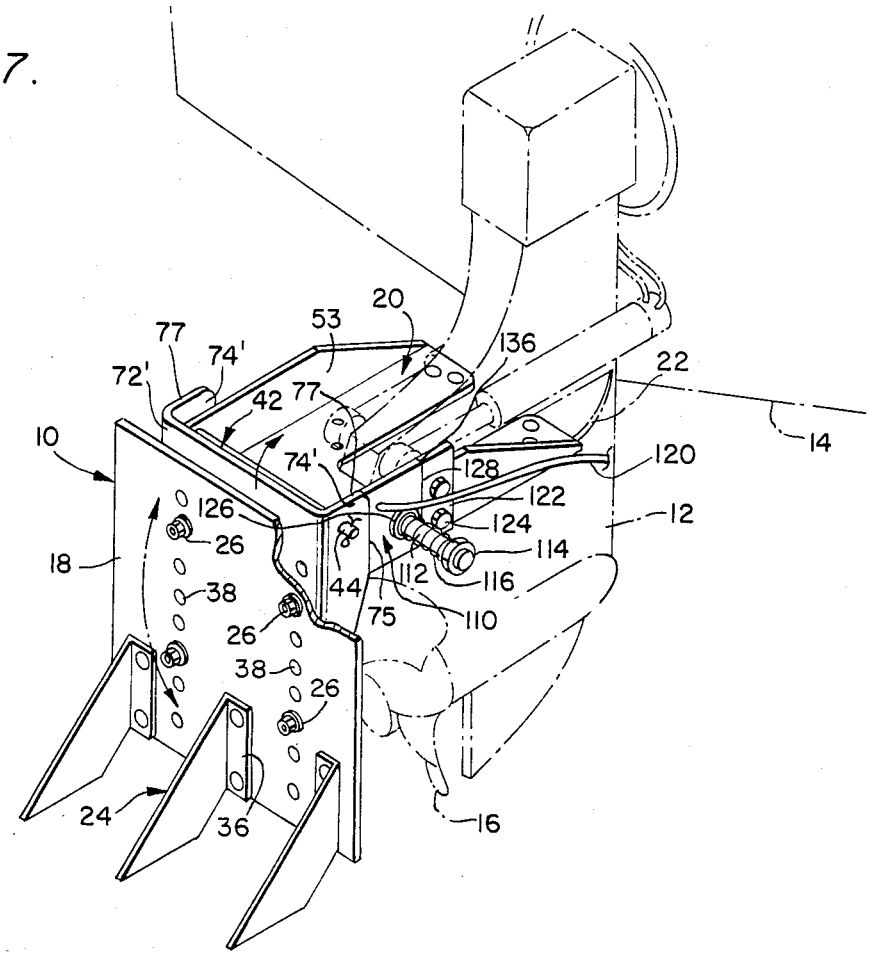
FIGS. 7 and 8 are respectively a perspective view and a plan view of a further embodiment of this invention including a simple detent mechanism for retaining the deflection plate in its horizontal position.
Figure 8:
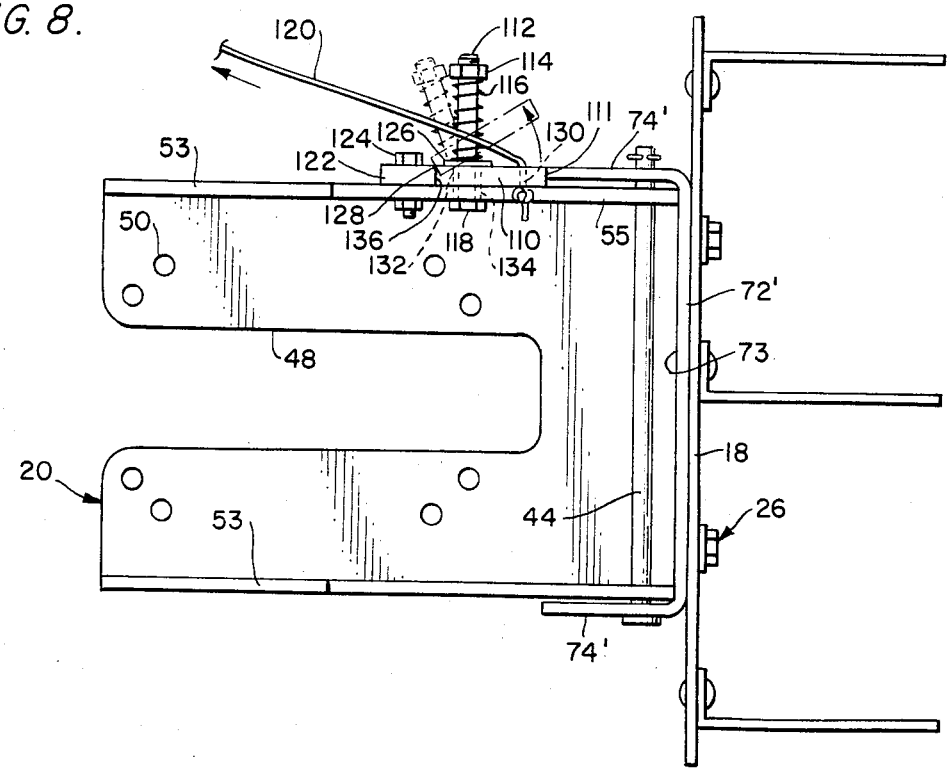

A further embodiment of this invention is shown in FIGS. 7 and 8, as including a detent mechanism for locking the rotatable member 42 and thus the deflection plate 18 in each of its first vertical and second horizontal positions. In particular, the embodiment of FIGS. 7 and 8 comprises a detent mechanism in the form of a locking plate 110 that replaces the spring biased detent member 40 and the plurality of detent slots 76 disposed within the rotatable member 42. The embodiment of FIGS. 7 and 8 is a simpler mechanism that is less costly to manufacture and assemble. A review of FIGS. 7 and 8 indicates that similar elements have been designated with numerals consistent with those of the description of the previous embodiment. In a similar fashion to the previous embodiments, the deflection plate 18 is designed to rotate from a first vertical position, wherein the deflection plate 18 is disposed to confront the propeller wash towards a second horizontal position wherein the deflection plate 18 is disposed substantially parallel with the surface of the water. In the second postion, the deflection plate 18 no longer effects the propeller wash or attenuates the speed of the boat.

When it is desired to dispose the deflection plate 18 in its first, vertical position, a cord 120 is pulled to disengage a locking edge surface 111 of the locking plate 110 from the rotatable member 42, and the motor is operated to move the boat in a rearward direction such that the deflection plate 18 is forced by the water flow into its first vertical position. When the deflection plate 18 is disposed in its first position, the locking mechanism in the form of the locking plate 110 is disposed by the action of a spring 116 in place as shown in FIGS. 7 and 8 to present the locking edge surface 111 against a forwardly facing surface 75 of the flanges 74' associated with the rotatable member 42. As shown in FIG. 7, the edge surface 75 of the flange 74' mates with the locking surface 111 over a large area to ensure that the deflection plate 18 is secured in its first vertical position.

As seen in FIGS. 7 and 8, the locking plate 110 is retained in a first locking position with respect to the rotatable member 42 by the spring 116 supported upon a stud 112. The stud 112 includes a head 118 and is loosely disposed through an opening 134 of the flange 53 and an opening 132 of the locking plate 110. The helically shaped spring 116 is disposed about the stud 112 and is secured at one end by a retaining nut 114 threadably disposed about the stud 112, while the other end of the spring 116 presses an annularly shaped washer 126 against the locking plate 110, thereby retaining the locking plate 110 in its first locking position.

A fastening member or plate 122 of substantially rectangular configuration is affixed to the uppermost flange 53 as shown in FIG. 8 by a pair of suitable fasteners 124 such as nuts and bolts. The fastening member 122 presents a stabilizing surface 128 to the locking plate 110, whereby the locking plate 110 is prevented from rotating about the stud 112 and, in particular, presents its relatively fixed locking surface 111 to the flange 74 of the rotatable member 42, when the locking plate 110 is disposed in its first locking position as shown in FIGS. 7 and 8.

To permit the rotatable member 42 and its deflection plate 18 to rotate in a clockwise direction as shown by the arrow in FIG. 7, the locking plate 110 is rotated from its first locking position as shown in solid line to a second released position as shown in dotted line in FIG. 8. In particular, the cord 120 extends through an opening 130 of the locking plate 110 and is secured thereto by a loop tied in one end of the cord 120. The cord 120 extends to the front of the boat whereby the operator may grasp the other end of the cord 120 to pull thereon, whereby the locking plate 110 is disposed to its second released position. In the released position, the locking surface 111 of the locking plate 110 no longer abuts the edge surface 75 of the flanges 74' and, therefore, the rotatable member 42 is free to be directed by the force of the moving water, towards its second (horizontal) position in which the deflection plate 18 is disposed substantially parallel to the water's surface. More specifically, the locking plate 110 abuts the surface 128 of the fastening member 122 or, more particularly, an edge as defined by the surface 128 and the outer exposed surface of the fastening member 122. This edge provides a pivot line about which the locking plate 110 is rotated as the boat's operator pulls the cord 120. It is understood that the stud 112 is loosely fitted within the opening 132 of the plate 110 and the opening of the flange 53 to permit the deflection of the stud 112, as shown in dotted line in FIG. 8, and thus the described rotation of the locking plate 110.

After being rotated to its second (horizontal) position, the rotatable member 42 and thus the deflection plate 18 are locked in that position by the action of the locking plate 110. In particular, the flange 74' has an upper surface 77 that upon rotation engages in a flush fashion with the locking edge surface 111, to thereby lock the rotatable member 42 and its deflection plate 18 in the second (horizontal) position. The helically shaped spring 116 disposes the locking plate 110 to its first locking position, whereby its locking edge surface 111 engages the surface 77 of the flange 74'.

Thus, there has been shown a significant advance in the art that permits a deflection plate, as taught by this invention, to be adapted to any of a number of boat motors, boats and/or propellers of varying size. To this end, the deflection plate is rotatively mounted in a variety of positions with respect to the propeller's wash. It is also contemplated that deflection plates of varying size may be readily mounted dependent upon motor, boat and/or propeller size. Further, a vane or illustratively, a plurality of vanes are suspended from the deflection plate and have an extended portion oriented below the lower most edge or portion of the deflection plate to stabilize boat movement and control.

In considering this invention, it should be remembered that the present disclosure is illustrative only, and the scope of the invention should be determined by the appended claims.

We claim:

1. Speed controlling apparatus adapted to be mounted with respect to a boat's motor, which drives a propeller for forming a wash directed along a path rearwardly of the boat's stern, said apparatus comprising:

a. a deflection plate;

b. means for mounting said deflection plate with respect to the boat's motor for movement between a first position confronting the propeller wash and a second position remote from the path of the propeller wash; and c. at least one vane fixedly attached to said deflection plate and extending in a direction along and into the path of the propeller wash for providing increased stability and control of the boat's movement through water and said vane comprises an extended portion that extends below the lower most edge of the said deflection plate and into the propeller wash.

2. Speed controlling apparatus as claimed in claim 1, wherein there is included a plurality of said vanes, said vanes disposed substantially parallel to each other.

3. Speed controlling apparatus as claimed in claim 1, wherein said means for mounting includes means for releasably and variably coupling said deflection plate with respect to said boat's motor so that said deflection plate may be selectively positioned with respect to the path of the propeller wash.

4. Speed controlling apparatus as claimed in claim 3, wherein said vane comprises an extended portion that extends below the lower most edge of said deflection plate, and said mounting means disposes said deflection plate such that its lower most edge is disposed to partially confront the propeller wash and to permit said extended portion of said vane to extend into and to be operative upon the propeller wash to enhance boat stability.

5. Speed controlling apparatus as claimed in claim 1, wherein there is included a plurality of vanes.

6. Speed controlling apparatus as claimed in claim 1, wherein said vane has a leading edge slanted with respect to said path, and a trailing edge slanted with respect to said path.

7. Speed controlling apparatus as claimed in claim 1, wherein the propeller has a given diameter, and said deflection plate has a minimum dimension disposed perpendicular to said path that is equal to or greater than the given propeller diameter.

8. Speed controlling apparatus as claimed in claim 1, wherein:

said means for mounting comprises a mounting plate adapted to be mounted to the boat's motor and including at least one flange, and a locking plate disposable between a first locking position wherein said locking plate presents a locking surface to retain said deflection plate in its first position and a second released position wherein said locking surface is removed from said deflection plate thereby permitting said deflection plate to move toward its second position under the influence of the propeller's wash.

9. Speed controlling apparatus as claimed in claim 8, wherein there is further included resilient means for biasing said locking plate in to its locking position with respect to said deflection plate.

10. Speed controlling apparatus as claimed in claim 9, wherein said resilient means includes a stud element loosely disposed through openings within said flange and said locking plate and a spring disposed about said stud for resiliently disposing said locking plate toward its first locking position.

11. Speed controlling apparatus as claimed in claim 10, wherein there is further included a fastening member affixed to said flange and presenting a pivoting edge to said locking member, whereby said locking member may be rotatably disposed about said pivoting edge from said first locking position to said second released position.

12. Speed controlling apparatus as claimed in claim 11, wherein there is included a cord having one end attached to said locking plate, whereby a force may be exerted via said cord to dispose said locking plate from its first locking position to its released position.

13. Speed controlling apparatus as claimed in claim 1, wherein said means for mounting includes means for releasably and variably coupling said deflection plate with respect to said boat's motor so that said deflection plate may be selectively positioned with respect to the path of the propeller wash.

14. Speed controlling apparatus as claimed in claim 13, wherein said means for mounting comprises a mounting plate adapted to be fixedly secured with respect to the boat's stern, a rotatable member rotatively coupled to said mounting plate for movement between said first and second positions, and releasable fastening means for variably coupling said deflection plate to said rotatable member in a selected one of a plurality of positions.

15. Speed controlling apparatus as claimed in claim 1, wherein said vane has a leading edge slanted with respect to said path, and a trailing edge slanted with respect to said path.

16. Speed controlling apparatus as claimed in claim 14, wherein said rotatable member has a first set of openings therein, and said deflection plate has a plurality of sets of openings of a configuration similar to said first set of openings, whereby said plate may be disposed in said plurality of positions corresponding to the positions of said plurality of sets of openings.

17. Speed controlling apparatus as claimed in claim 14, wherein there is included hydraulic means interconnected between said deflection plate and said mounting plate for moving said deflection plate between said first and second positions.

18. Speed controlling apparatus as claimed in claim 1, wherein:

said means for mounting comprises a mounting plate adapted to be mounted to the boat's motor and including at least one flange, and a locking plate disposable between a first locking position wherein said locking plate presents a locking surface to retain said deflection plate in its first position and a second released position wherein said locking surface is removed from said deflection plate thereby permitting said deflection plate to move toward its second position under the influence of the propeller's wash.

19. Speed controlling apparatus as claimed in claim 18, wherein there is a further included resilient means for biasing said locking plate in to its locked position with respect to said deflection plate.

20. Speed controlling apparatus as claimed in claim 19, wherein the resilient means includes a stud element loosely disposed through openings within said flange and said locking plate and a spring disposed about said stud for resiliently disposing said locking plate toward its first locking position.

21. Speed controlling apparatus adapted to be mounted with respect to a boat's motor, which drives a propeller for forming and directing a wash rearwardly of the boat's stern, said apparatus comprising:

(a) a deflection plate; and (b) means for mounting said deflection plate with respect to the boat's motor for movement between a first position confronting the propeller wash and a second position remote from the path of the propeller wash, said means for mounting comprises a mounting plate adapted to be fixedly secured with respect to the boat's stern, a rotatable member rotatively coupled to said mounting plate for movement between said first and second positions, wherein said rotatable member has a first set of openings therein, and said deflection plate has a plurality of sets of openings of a configuration similar to said first set of openings, whereby said plate may be disposed in said plurality of positions corresponding to the positions of said plurality of sets of openings and also including releasable fastening means for releasably and variably coupling said deflection plate to said rotatable member in a selected one of a plurality of positions with respect to the path of the propeller wash.

22. Speed controlling apparatus as claimed in claim 21, wherein there is included hydraulic means interconnected between said deflection plate and said mounting plate for moving said deflection plate between said first and second positions.

23. Speed controlling apparatus as claimed in claim 22, wherein said hydraulic means includes a first end fixedly attached with respect to said mounting plate and a second end, and means for releasably attaching said second end to said deflection plate, whereby said deflection plate may be readily replaced.

* * * * *